US010351338B1

(12) United States Patent
Tyle

(10) Patent No.: US 10,351,338 B1
(45) Date of Patent: Jul. 16, 2019

(54) GARBAGE CAN RETENTION ASSEMBLY

(71) Applicant: Vitezslav Tyle, Manville, NJ (US)

(72) Inventor: Vitezslav Tyle, Manville, NJ (US)

( * ) Notice: Subject to any disclaimer, the term of this patent is extended or adjusted under 35 U.S.C. 154(b) by 0 days.

(21) Appl. No.: 16/019,679

(22) Filed: Jun. 27, 2018

(51) Int. Cl.
*B65F 1/14* (2006.01)

(52) U.S. Cl.
CPC ..... *B65F 1/141* (2013.01)

(58) Field of Classification Search
CPC ..... B65F 1/141; B65F 1/1415; B65F 1/1421; A47B 81/007
USPC ..... 248/530, 533
See application file for complete search history.

(56) References Cited

U.S. PATENT DOCUMENTS 354,438 A * 12/1886 Randall ..... A47B 45/00 248/149
666,880 A * 1/1901 Zerrahn ..... B65F 1/141 248/137
1,194,030 A * 8/1916 King ..... A47B 45/00 211/105
1,779,867 A * 10/1930 Ahrold ..... B65F 1/141 248/146
2,203,632 A * 6/1940 Munson ..... A47B 13/06 248/146
2,297,193 A * 9/1942 Silverman ..... B65F 1/141 248/146
2,304,810 A * 12/1942 Fetterman ..... B65F 1/141 220/475
2,501,895 A * 3/1950 Gayle ..... B65F 1/141 248/146
2,503,531 A * 4/1950 Welter ..... B65F 1/141 211/181.1
2,508,683 A * 5/1950 Nelson ..... B65F 1/141 248/146
2,509,284 A * 5/1950 Allen ..... B65F 1/141 248/149
2,513,630 A * 7/1950 Elliott ..... B65F 1/141 211/84
2,522,036 A * 9/1950 Haake ..... B65F 1/141 248/145
2,646,955 A * 7/1953 Russell ..... B65F 1/141 248/149
2,661,921 A * 12/1953 Brustein ..... A47J 47/16 248/147

(Continued)

FOREIGN PATENT DOCUMENTS

DE 9304168 U1 * 9/1993 ..... B65F 1/1415
DE 9409038 U1 * 11/1994 ..... B65F 1/1415

(Continued)

*Primary Examiner* — Stanton L Krycinski

(57) ABSTRACT

A garbage can retention assembly includes a plurality of stakes that is each inserted into ground. A ring and a collar are each coupled to the stakes and each of the ring and the collar are horizontally oriented when the stakes are inserted into the ground. A garbage can is positioned to extend through the ring and the collar having the garbage can standing on the ground. Thus, the ring and the collar surrounds the garage can to inhibit the garbage can from tipping over. A pair of gates is each hingedly coupled to the collar. Each of the gates is positionable in a closed position having the collar and each of the gates encircling the garbage can when the garbage can is positioned in the collar and the ring. Each of the gates is positionable in an open position thereby facilitating the garbage can to pass therebetween.

9 Claims, 5 Drawing Sheets

(56) References Cited

U.S. PATENT DOCUMENTS 2,673,053 A * 3/1954 Kilian ..... B65F 1/141 220/475
2,715,005 A * 8/1955 Hildebrand ..... B65F 1/141 248/154
2,723,099 A * 11/1955 Smith ..... B65F 1/141 248/150
2,907,486 A * 10/1959 Perez ..... B65F 1/141 220/4.26
2,924,377 A * 2/1960 Lewis ..... B65F 1/10 220/502
2,998,952 A 9/1961 Williams
3,079,119 A * 2/1963 Brooks ..... B65F 1/141 248/146
3,102,707 A * 9/1963 Jacklin ..... B65F 1/141 220/737
3,141,644 A * 7/1964 Baird ..... B65F 1/141 248/146
3,160,380 A * 12/1964 Blades ..... B65F 1/141 248/154
3,173,547 A 3/1965 Alissandratos
3,186,555 A 6/1965 Ventura
3,227,284 A * 1/1966 Smith ..... B65F 1/141 211/85.19
3,232,441 A * 2/1966 Mitscherling ..... B65F 1/141 211/85.19
3,272,466 A * 9/1966 Sherman ..... B65F 1/141 248/146
3,276,733 A * 10/1966 Rosser ..... B65F 1/141 248/146
3,313,423 A * 4/1967 Anders ..... B65F 1/141 211/85.19
3,399,854 A * 9/1968 Patterson ..... B65F 1/141 211/170
3,520,505 A * 7/1970 Allen ..... B65F 1/141 211/85.19
3,750,990 A 8/1973 Jacobs
3,933,328 A * 1/1976 Michelbrink ..... B65F 1/141 248/146
4,084,701 A * 4/1978 White ..... B65F 1/141 211/81
4,157,801 A * 6/1979 Elmer ..... B65B 67/12 248/101
4,488,697 A * 12/1984 Garvey ..... B65F 1/1415 248/101
4,527,695 A 7/1985 Arms
D294,994 S * 3/1988 Burgett ..... D34/6
4,741,494 A * 5/1988 Voornas ..... B65F 1/141 211/85.19
4,901,959 A * 2/1990 Stage ..... B65B 67/1205 220/4.24
D318,352 S 7/1991 Allen
5,232,188 A * 8/1993 Troncone ..... B65F 1/141 248/154
6,520,457 B1 * 2/2003 Yardley ..... B65B 67/1233 248/97
6,786,349 B2 9/2004 Najd
6,951,328 B1 * 10/2005 Drapeau ..... B65F 1/141 211/85.19
7,018,090 B2 * 3/2006 Moore ..... B01F 15/00733 248/146
7,284,732 B1 * 10/2007 Lopa ..... B65B 67/1233 248/101
7,757,881 B1 * 7/2010 Riley ..... B65F 1/141 220/480
8,167,254 B2 * 5/2012 Hopkins ..... B65F 1/12 248/137
8,746,636 B2 * 6/2014 Rauchut ..... B01F 15/00733 248/146
9,333,641 B2 5/2016 Macias
9,440,789 B2 * 9/2016 Moayed Sabeti ..... B65B 67/04
2009/0256034 A1 * 10/2009 Poyner ..... B01F 15/00733 248/154
2010/0044387 A1 * 2/2010 Howard ..... B65F 1/141 220/730

FOREIGN PATENT DOCUMENTS

DE 29622381 U1 * 2/1997 ..... B65F 1/0006
FR 2972716 A1 * 9/2012 ..... B65F 1/068

* cited by examiner

GARBAGE CAN RETENTION ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to retention devices and more particularly pertains to a new retention device for inhibiting a garbage can from tipping over.

BRIEF SUMMARY OF THE INVENTION

An embodiment of the disclosure meets the needs presented above by generally comprising a plurality of stakes that is each inserted into ground. A ring and a collar are each coupled to the stakes and each of the ring and the collar are horizontally oriented when the stakes are inserted into the ground. A garbage can is positioned to extend through the ring and the collar having the garbage can standing on the ground. Thus, the ring and the collar surrounds the garage can to inhibit the garbage can from tipping over. A pair of gates is each hingedly coupled to the collar. Each of the gates is positionable in a closed position having the collar and each of the gates encircling the garbage can when the garbage can is positioned in the collar and the ring. Each of the gates is positionable in an open position thereby facilitating the garbage can to pass therebetween.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
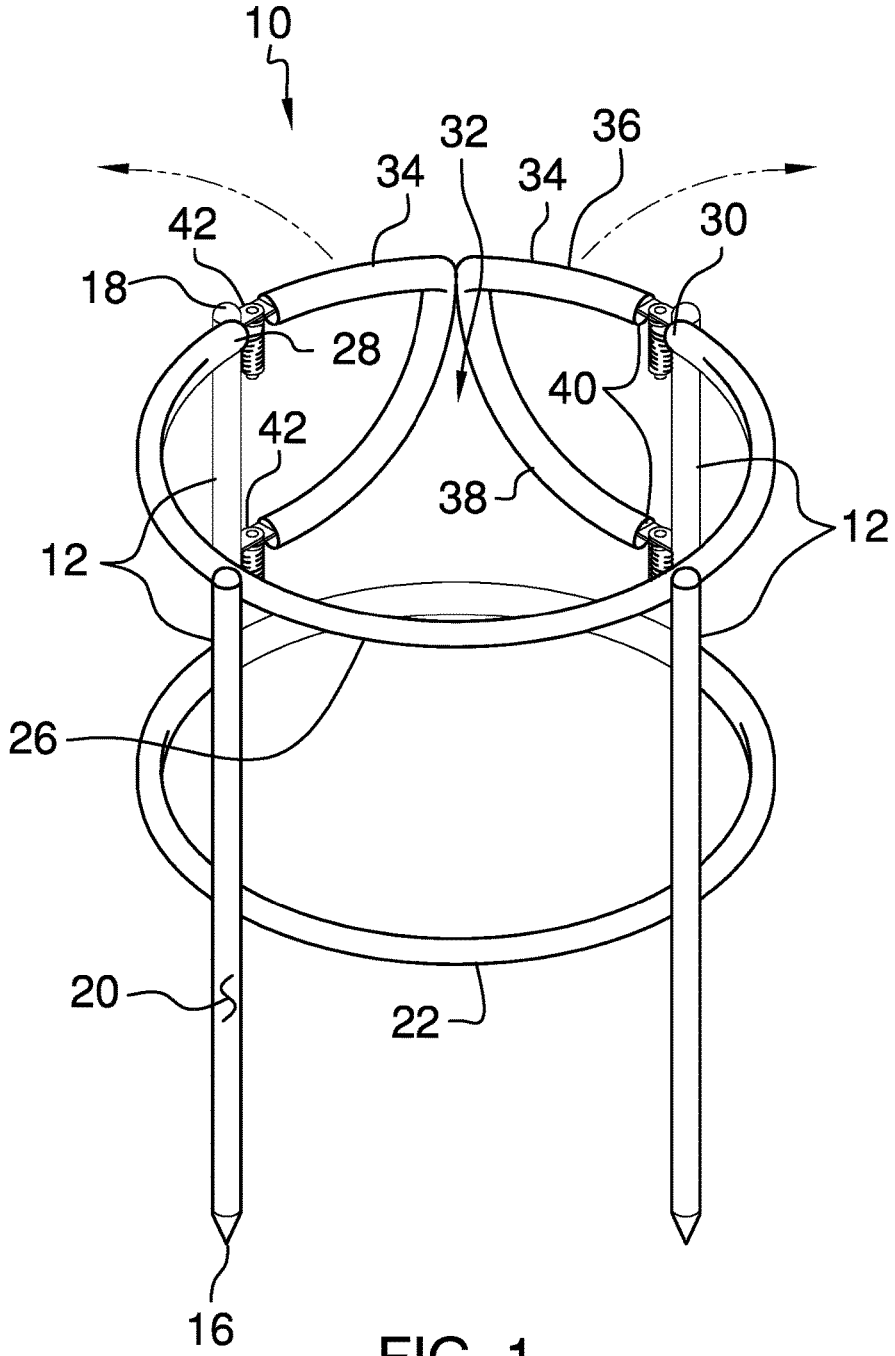
FIG. 1 is a top perspective view of a garbage can retention assembly according to an embodiment of the disclosure.
Figure 2:
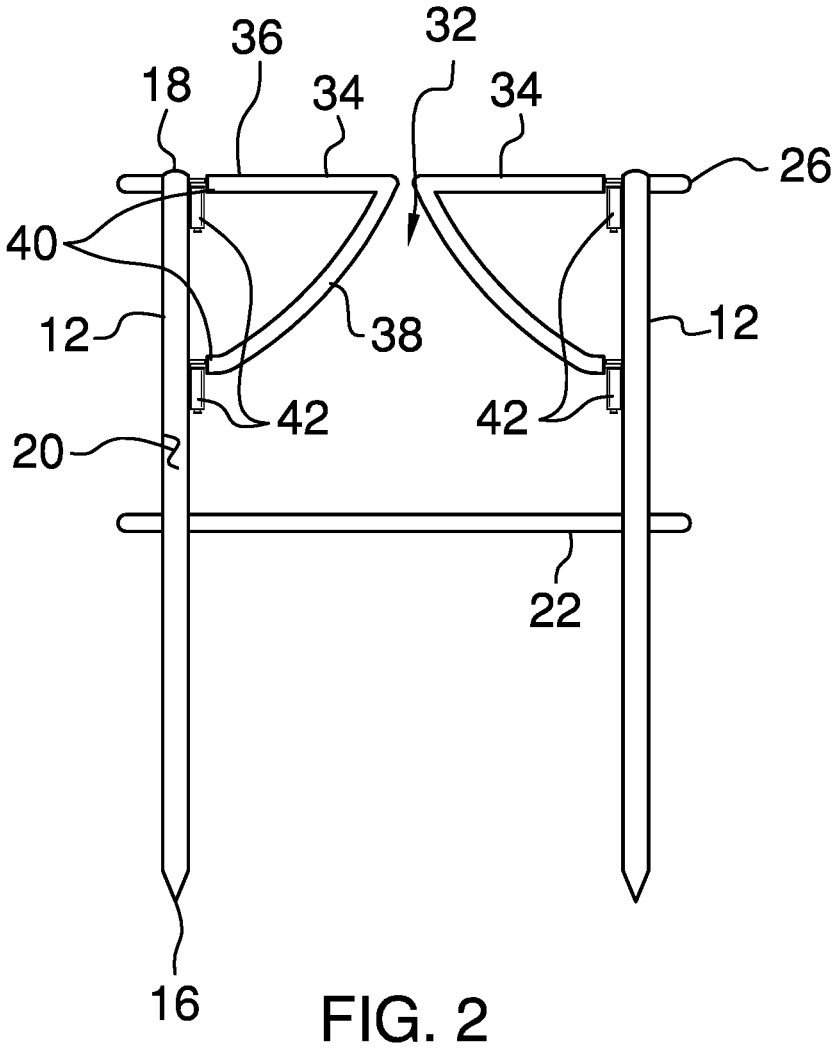
FIG. 2 is a front view of an embodiment of the disclosure.
Figure 3:
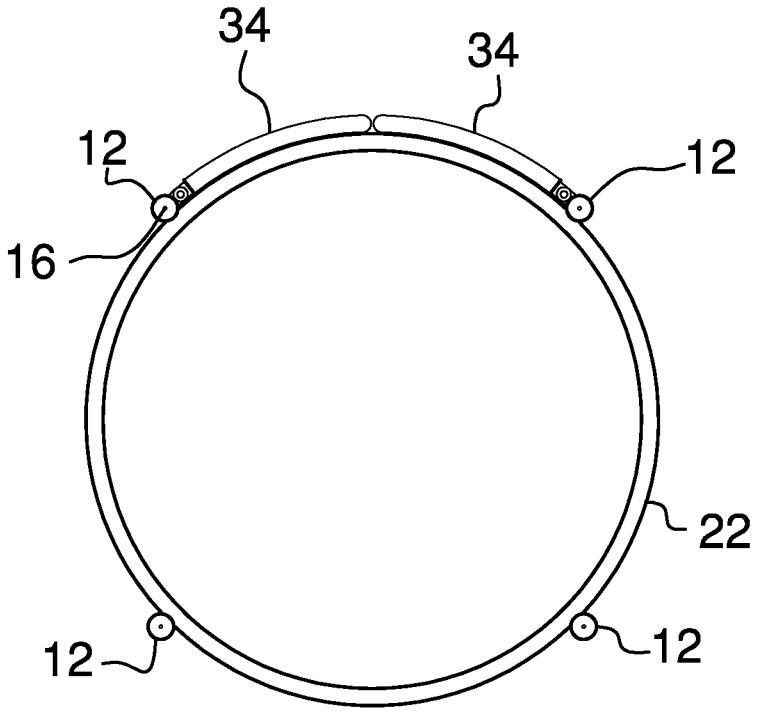
FIG. 3 is a bottom view of an embodiment of the disclosure.
Figure 4:
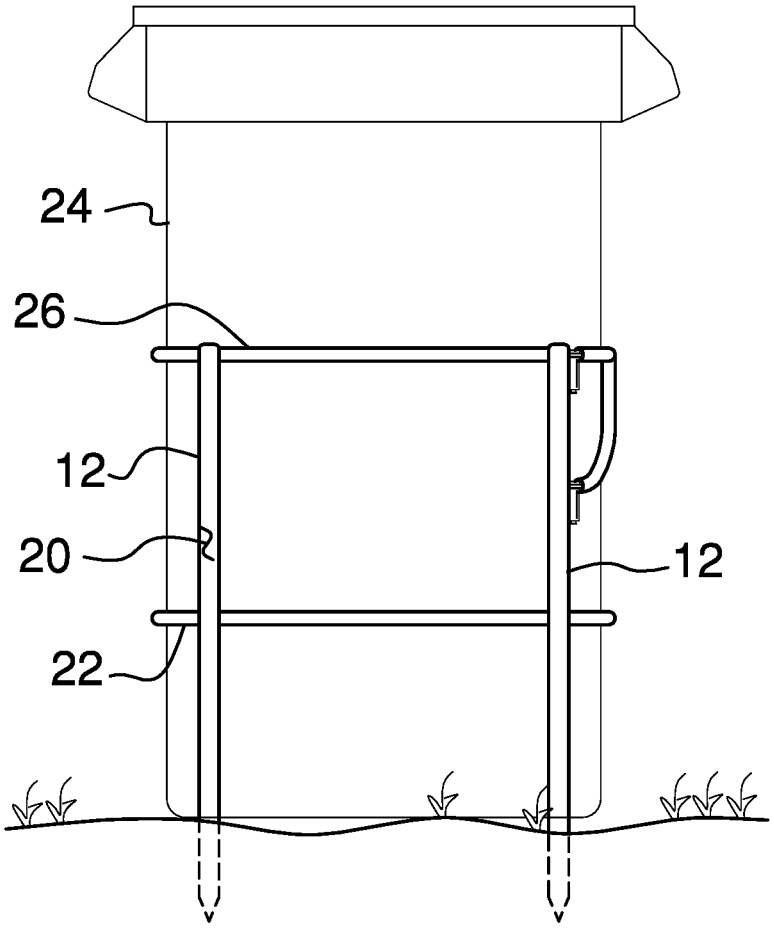
FIG. 4 is a perspective in-use view of an embodiment of the disclosure.

With reference now to the drawings, and in particular to FIGS. 1 through 6 thereof, a new retention device embodying the principles and concepts of an embodiment of the disclosure and generally designated by the reference numeral 10 will be described.

As best illustrated in FIGS. 1 through 6, the garbage can retention assembly 10 generally comprises a plurality of stakes 12 and each of the stakes 12 is inserted into ground 14. Each of the stakes 12 has a first end 16, a second end 18 and an outer surface 20 extending therebetween. The first end 16 of each of the stakes 12 tapers to a point for piercing the ground 14. A ring 22 is provided and each of the stakes 12 is coupled to the ring 22. Moreover, the ring 22 is horizontally oriented when the stakes 12 are inserted into the ground 14. A garbage can 24 is positioned to extend through the ring 22 having the garbage can 24 standing on the ground 14. In this way the ring 22 surrounds the garbage can 24 to inhibit the garbage can 24 from tipping over or being relocated.

The ring 22 is coupled to the outer surface 20 of each of the stakes 12 and the ring 22 is centrally positioned between the first 16 and second 18 ends of each of the stakes 12. The stakes 12 are spaced apart from each other and are distributed around the ring 22. A collar 26 is provided and each of the stakes 12 is coupled thereto such that the collar 26 is horizontally oriented when the stakes 12 are inserted into ground 14. The collar 26 is spaced from the ring 22 and the collar 26 surrounds the garbage can 24 when the garbage can 24 is positioned in the ring 22.

The collar 26 has a primary end 28 and a secondary end 30, and the collar 26 is curved between the primary 28 and secondary 30 ends such that the collar 26 forms an open loop. The collar 26 is coupled to the outer surface 20 of each of the stakes 12 and the collar 26 is aligned with the second end 18 of each of the stakes 12. Each of the primary 28 and secondary 30 ends is aligned with a respective one of the stakes 12 to define a garbage can space 32 in the collar 26. The garbage passes through the garbage can space 32 when the garbage can 24 is positioned in the collar 26 and the ring 22.

A pair of gates 34 is each hingedly coupled to the collar 26. Each of the gates 34 is positionable in a closed position having the collar 26 and each of the gates 34 encircling the garbage can 24 when the garbage can 24 is positioned in the collar 26 and the ring 22. Additionally, each of the gates 34 is positionable in an open position thereby facilitating the garbage can 24 to pass therebetween. Each of the gates 34 comprises a first member 36 that is coupled to a second member 38, and each of the first 36 and second 38 members of each of the gates 34 has a free end 40. The first member 36 of a respective one of the gates 34 is oriented to form an acute angle with the second member 38 of the respective gate 34. Each of the first 36 and second 38 members of each of the gates 34 is concavely arcuate between the free end 40 and an intersection between the first 36 and second 38 members. Thus, each of the gates 34 conforms to a curvature of the collar 26 when the gates 34 are in the closed position.

Figure 5:
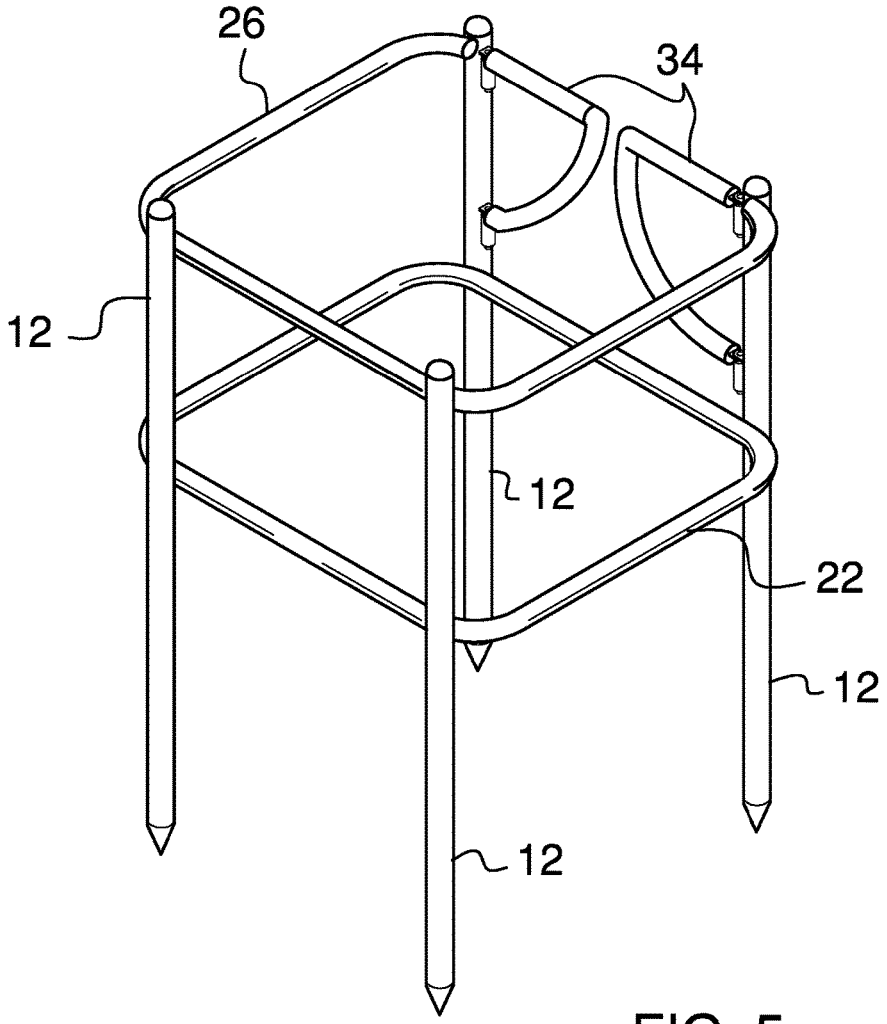
FIG. 5 is a perspective view of an alternative embodiment of the disclosure.

A plurality of hinges 42 is provided and each of the hinges 42 is coupled to the outer surface 20 of the respective one of the stakes 12. Each of the hinges 42 has the free end 40 of a respective one of the first 36 and second 38 members of a respective one of the gates 34 being coupled thereto. Moreover, each of the hinges 42 biases the respective gate into the closed position. Each of the hinges 42 may be spring loaded hinges or other type of biasing hinge. In an alternative embodiment as shown in FIG. 5, each of the ring and the collar may have a plurality of intersecting sides such that each of the ring and the collar has a rectangular shape.

In use, the first end 16 of each of the stakes 12 is pressed into the ground 14 at a selected location. Each of the gates 34 is positioned in the open position and the garbage can 24 is passed through the garbage can space 32. The garbage can 24 is lowered to extend through the ring 22 and stood upon the ground 14. Each of the gates 34 is released and the hinges 42 bias the gates 34 in the closed position. Thus, the garbage can 24 is encircled by the ring 22, the collar 26 and the gates 34 thereby inhibiting the garage can from tipping over from wind or the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A garbage can retention assembly being configured to inhibit a garbage can from tipping over or being relocated, said assembly comprising:

a plurality of stakes, each of said stakes being inserted into ground;

a ring having each of said stakes being coupled thereto such that said ring is horizontally oriented when said stakes are inserted into the ground, said ring having a garbage can being positioned to extend therethrough having the garbage can standing on the ground wherein said ring surrounds the garage can to inhibit the garbage can from tipping over or being relocated;

a collar having each of said stakes being coupled thereto such that said collar is horizontally oriented when said stakes are inserted into the ground, said collar being spaced from said ring such that said collar surrounds the garbage can when the garbage can is positioned in said ring; and a pair of gates, each of said gates being hingedly coupled to an associated one of said stakes, each of said gates being positionable in a closed position having said collar and each of said gates encircling the garbage can when the garbage can is positioned in said collar and said ring, each of said gates being positionable in an open position thereby facilitating the garbage can to pass therebetween.

2. The assembly according to claim 1, further comprising each of said stakes having a first end, a second end and an outer surface extending therebetween, said first end of each of said stakes tapering to a point for piercing the ground.

3. The assembly according to claim 2, wherein said ring is coupled to said outer surface of each of said stakes, said ring being centrally positioned between said first and second ends of each of said stakes, said stakes being spaced apart from each other and being distributed around said ring.

4. The assembly according to claim 3, wherein said collar has a primary end and a secondary end, said collar being curved between said primary and secondary ends such that said collar forms an open loop, said collar being coupled to said outer surface of each of said stakes, said collar being aligned with said second end of each of said stakes.

5. The assembly according to claim 4, wherein each of said primary and secondary ends is aligned with a respective one of said stakes to define a garbage can space in said collar thereby facilitating the garbage can to pass through said garbage can space when the garbage can is positioned in said collar and said ring.

6. The assembly according to claim 2, wherein each of said gates comprises a first member being coupled to a second member, each of said first and second members of each of said gates having a free end, said first member of a respective one of said gates being oriented to form an acute angle with said second member of said respective gate.

7. The assembly according to claim 6, wherein each of said first and second members of each of said gates is concavely arcuate between said free end and an intersection between said first and second members such that each of said gates conforms to a curvature of said collar when said gates are in said closed position.

8. The assembly according to claim 7, further comprising a plurality of hinges, each of said hinges being coupled to said outer surface of said respective one of said stakes, each of said hinges having said free end of a respective one of said first and second members of a respective one of said gates being coupled thereto, each of said hinges biasing said respective gate into said closed position.

9. A garbage can retention assembly being configured to inhibit a garbage can from tipping over or being relocated, said assembly comprising:

a plurality of stakes, each of said stakes being inserted into ground, each of said stakes having a first end, a second end and an outer surface extending therebetween, said first end of each of said stakes tapering to a point for piercing the ground;

a ring having each of said stakes being coupled thereto such that said ring is horizontally oriented when said stakes are inserted into the ground, said ring having a garbage can being positioned to extend therethrough having the garbage can standing on the ground wherein said ring surrounds the garage can to inhibit the garbage can from tipping over or being relocated, said ring being coupled to said outer surface of each of said stakes, said ring being centrally positioned between said first and second ends of each of said stakes, said stakes being spaced apart from each other and being distributed around said ring;

a collar having each of said stakes being coupled thereto such that said collar is horizontally oriented when said stakes are inserted into the ground, said collar being spaced from said ring such that said collar surrounds the garbage can when the garbage can is positioned in said ring, said collar having a primary end and a secondary end, said collar being curved between said primary and secondary ends such that said collar forms an open loop, said collar being coupled to said outer surface of each of said stakes, said collar being aligned with said second end of each of said stakes, each of said primary and secondary ends being aligned with a respective one of said stakes to define a garbage can space in said collar thereby facilitating the garbage can to pass through said garbage can space when the garbage can is positioned in said collar and said ring;

a pair of gates, each of said gates being hingedly coupled to an associated one of said stakes, each of said gates being positionable in a closed position having said collar and each of said gates encircling the garbage can when the garbage can is positioned in said collar and said ring, each of said gates being positionable in an open position thereby facilitating the garbage can to pass therebetween, each of said gates comprising a first member being coupled to a second member, each of said first and second members of each of said gates having a free end, said first member of a respective one of said gates being oriented to form an acute angle with said second member of said respective gate, each of said first and second members of each of said gates being concavely arcuate between said free end and an intersection between said first and second members such that each of said gates conforms to a curvature of said collar when said gates are in said closed position; and a plurality of hinges, each of said hinges being coupled to said outer surface of said respective one of said stakes, each of said hinges having said free end of a respective one of said first and second members of a respective one of said gates being coupled thereto, each of said hinges biasing said respective gate into said closed position.

* * * * *